US007748658B2

(12) United States Patent
Schlichter

(10) Patent No.: US 7,748,658 B2
(45) Date of Patent: Jul. 6, 2010

(54) SLIVER DISCHARGE DEVICE

(75) Inventor: Stefan Schlichter, Viersen (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 1293 days.

(21) Appl. No.: 11/247,276

(22) Filed: Oct. 12, 2005

(65) Prior Publication Data

US 2006/0027695 A1 Feb. 9, 2006

Related U.S. Application Data

(63) Continuation-in-part of application No. 10/350,016, filed on Jan. 24, 2003, now abandoned.

(30) Foreign Application Priority Data

Feb. 7, 2002 (DE) ..... 102 05 061

(51) Int. Cl.
*B21C 47/10* (2006.01)

(52) U.S. Cl. ..... 242/361.4

(58) Field of Classification Search ..... 242/361.4, 242/361.5, 360, 363; 53/67, 118, 503, 64, 53/70, 71, 116, 117, 235, 245, 249, 250, 53/251, 429, 430, 473; 19/157, 159 A, 159 R, 19/160

See application file for complete search history.

(56) References Cited

U.S. PATENT DOCUMENTS

| | | | | |
|---|---|---|---|---|
| 928,563 | A | 7/1909 | Thoens | |
| 1,948,615 | A | 2/1934 | Clark | |
| 2,425,301 | A | 8/1947 | Browner | |
| 3,060,518 | A | 10/1962 | Moore Hill | |
| 3,226,794 | A * | 1/1966 | Erb | 242/361.4 |
| 3,281,913 | A | 11/1966 | Morehead et al. | |
| 3,348,783 | A * | 10/1967 | Mackie | 242/472.2 |
| 3,482,795 | A * | 12/1969 | Mackie | 242/472.2 |
| 3,496,862 | A | 2/1970 | Sowerby | |
| 3,509,687 | A | 5/1970 | Fleissner | |
| 3,541,752 | A | 11/1970 | Ness | |

(Continued)

FOREIGN PATENT DOCUMENTS

| | | |
|---|---|---|
| CH | 1 28 869 | 11/1928 |

(Continued)

OTHER PUBLICATIONS

United Kingdom Search Report dated Mar. 13, 2006, issued in GB 0519748.8.

(Continued)

*Primary Examiner*—William A Rivera
(74) *Attorney, Agent, or Firm*—Venable LLP; Robert Kinberg; Steven J. Schwarz

(57) ABSTRACT

A device is provided on a spinning preparation machine for receiving a sliver from a discharge device of the spinning preparation machine and transporting the sliver to a downstream machine, the spinning preparation machine having a depositing region. The device has a support for receiving the sliver deposited from the discharge device in the depositing region, and a moving device for moving the deposited sliver relative to the discharge device in the depositing region for forming a free standing sliver bundle, and for moving the free standing sliver bundle out of the depositing region for transport to a downstream machine.

19 Claims, 5 Drawing Sheets

U.S. PATENT DOCUMENTS

| | | | | |
|---|---|---|---|---|
| 3,808,641 | A | 5/1974 | Schneider et al. | |
| 4,683,619 | A | 8/1987 | Langen et al. | |
| 4,723,344 | A | 2/1988 | Leifeld | |
| 4,891,918 | A | 1/1990 | Wiley | |
| 4,956,969 | A | 9/1990 | Raasch | |
| 5,081,744 | A | 1/1992 | Siegenthaler et al. | |
| 5,085,377 | A | 2/1992 | Rohrer et al. | |
| 5,125,210 | A | 6/1992 | Lang et al. | |
| 5,200,269 | A | 4/1993 | Lukhard et al. | |
| 5,257,897 | A | 11/1993 | Yamamoto et al. | |
| 5,412,845 | A | 5/1995 | Ueding et al. | |
| 5,446,946 | A | 9/1995 | Leifeld | |
| 5,450,656 | A * | 9/1995 | Ueding et al. | 19/159 R |
| 5,491,877 | A | 2/1996 | Leifeld | |
| 5,511,372 | A | 4/1996 | Liedgens | |
| 5,528,797 | A | 6/1996 | Otmar et al. | |
| 5,535,581 | A | 7/1996 | Tahara et al. | |
| 5,560,179 | A * | 10/1996 | Leifeld | 53/118 |
| 5,561,889 | A * | 10/1996 | Leifeld | 19/159 R |
| 5,575,040 | A | 11/1996 | Leifeld et al. | |
| 5,581,849 | A | 12/1996 | Kriegler et al. | |
| 5,595,049 | A | 1/1997 | Leifeld | |
| 5,787,553 | A | 8/1998 | Liedgens | |
| 5,826,812 | A | 10/1998 | Hand | |
| 5,829,100 | A | 11/1998 | Stentenbach | |
| 5,881,861 | A | 3/1999 | Langen | |
| 6,182,425 | B1 | 2/2001 | Ficker et al. | |
| 6,279,306 | B1 | 8/2001 | Langen | |
| 6,334,237 | B1 | 1/2002 | Tsuzuki | |
| 6,345,417 | B2 | 2/2002 | Lederi | |
| 6,425,163 | B1 | 7/2002 | von Gehlen | |
| 7,410,051 | B2 | 8/2008 | Warlick | |
| 2003/0146331 | A1* | 8/2003 | Schlichter | 242/361.4 |
| 2006/0027695 | A1* | 2/2006 | Schlichter | 242/361.4 |
| 2006/0065554 | A1 | 3/2006 | Warlick | |
| 2007/0063088 | A1 | 3/2007 | Schlichter | |
| 2007/0063089 | A1 | 3/2007 | Schlichter | |
| 2007/0068397 | A1 | 3/2007 | Schlichter | |
| 2007/0069058 | A1* | 3/2007 | Schlichter et al. | 242/361.5 |
| 2007/0069059 | A1 | 3/2007 | Schlichter | |
| 2008/0029637 | A1* | 2/2008 | Schlichter et al. | 242/472.1 |
| 2008/0244871 | A1 | 10/2008 | Vollrath | |

FOREIGN PATENT DOCUMENTS

| | | | |
|---|---|---|---|
| CH | 418 908 | | 8/1966 |
| CH | 436 199 | | 5/1967 |
| DE | 575 175 | A | 4/1933 |
| DE | 1081823 | B | 8/1962 |
| DE | 1 145 062 | | 3/1963 |
| DE | 1 875 947 | | 7/1963 |
| DE | 3422 140 | A1 | 12/1985 |
| DE | 38 19 854 | A1 | 1/1989 |
| DE | 37 34 425 | | 3/1989 |
| DE | 37 38 190 | C2 | 5/1989 |
| DE | 40 18 088 | | 1/1991 |
| DE | 43 04 988 | C1 | 4/1994 |
| DE | 44 07 849 | | 11/1994 |
| DE | 44 32 634 | A1 | 3/1996 |
| DE | 196 11 500 | A1 | 1/1997 |
| DE | 195 42 599 | A1 | 5/1997 |
| DE | 1985092 | | 5/2000 |
| DE | 42 17 981 | C2 | 9/2002 |
| DE | 102 05 061 | A1 | 8/2003 |
| DE | 10252174 | | 5/2004 |
| EP | 0311394 | | 4/1989 |
| EP | 0 320 467 | | 6/1989 |
| EP | 0 457 099 | | 11/1991 |
| FR | 650306 | B | 1/1929 |
| FR | 1 226 668 | | 7/1960 |
| FR | 1 395 509 | | 3/1965 |
| FR | 2021647 | | 7/1970 |
| FR | 2 540 476 | | 10/1984 |
| GB | 314190 | | 5/1928 |
| GB | 298 442 | | 10/1928 |
| GB | 317 029 | | 8/1929 |
| GB | 412893 | | 2/1934 |
| GB | 412 893 | | 7/1934 |
| GB | 966294 | | 8/1964 |
| GB | 1 166 650 | | 10/1969 |
| GB | 1 397 812 | | 6/1975 |
| GB | 1555650 | | 11/1979 |
| GB | 2205544 | | 12/1988 |
| GB | 2277936 | | 11/1994 |
| GB | 2287964 | | 10/1995 |
| GB | 2292392 | | 2/1996 |
| GB | 2385064 | | 8/2003 |
| GB | 242 0107 | | 5/2006 |
| JP | 61045868 | A | 3/1986 |
| JP | 61047835 | A | 3/1986 |
| WO | WO-03/078253 | A1 | 9/2003 |

OTHER PUBLICATIONS

German Search Reported dated Nov. 17, 2006, for DE 10 2005 045472.0.

Search Report from Turkish Application No. 2006/04816 dated Jul. 30, 2008.

Search Report from British Application No. 0805586.5 dated Jun. 30, 2008.

British Search Report dated Feb. 12, 2007 based on British Application No. GB0620168.5.

British Search Report dated Feb. 20, 2007 based on British Application No. GB0620181.8.

British Search Report dated Feb. 21, 2007 based on British Application No. GB0620179.2.

German Search Report dated Sep. 1, 2006 based on German Application No. 10 2006 012 581.9.

German Search Report dated Sep. 1, 2006 based on German Application No. 10 2006 012 483.9.

German Search Report dated Dec. 18, 2007 based on German Application No. 10 2007 016 340.3 and translation.

Search Report from German Application No. 10 2006 012 579.7 dated Sep. 5, 2006 and translation.

British Search Report dated Feb. 12 , 2007 based on British Application No. GB 0620182.6.

British Search Report dated Feb. 12, 2007 based on British Application No. GB 0620172.7.

Search Report from German Application No. 10 2006 012 565.7 dated Sep. 25, 2006 and translation.

Search Report from German Application No. 10 2006 012 484.7 dated Sep. 1, 2006 and translation.

British Search Report dated Feb. 12, 2007 based on British Application No. GB 0620170.1.

Search Report from German Application No. 10 2006 012 580.0 dated Sep. 7, 2006.

M.N. PABCKNŇ, KNUHbIE PA3PbIXU NTEUN XUOUKA, 1969.

* cited by examiner

SLIVER DISCHARGE DEVICE

CROSS-REFERENCE TO RELATED APPLICATION

This application is a continuation-in-part of U.S. patent application Ser. No. 10/350,016, filed Jan. 24, 2003, which claims priority to German Patent Application No. 102 05 061.9, filed Feb. 7, 2002, the priority of which is claimed herein. The contents of the foregoing applications are incorporated by reference in their entirety.

BACKGROUND OF THE INVENTION

The invention relates to a device on a spinning preparation machine, for example a carding machine or draw frame, involving the discharge of a sliver with a discharging device and depositing of the sliver on a support. The discharge device and the support can be moved relative to each other and the sliver (sliver bundle) deposited on the support can be fed to a processing machine downstream.

In a known device shown in European Patent Document EP 0 457 099, a sliver produced by a sliver delivery machine (a carding machine or draw frame) is deposited in a spinning can with a rectangular cross-section. In the process, the can moves back and forth within the depositing region. Once the can is filled with the ring-shaped deposited sliver, the can is moved out of the depositing region and is supplied to a downstream-connected device. A plurality of filled cans are stored in intermediate storage areas and the cans are supplied from there to, for example, a spinning machine. The cans are transported between the storage area and the spinning machine with the aid of a carriage. One disadvantage of the device is the high equipment cost for the system. A plurality of empty cans must be supplied to the depositing region of the machines for depositing the sliver and the cans filled with the sliver must then be removed again from the depositing region. Added to the expense for the structural adaptation of the machine to the can and the handling involved with the additional conveying or transport expenditure for the cans is the considerable expenditure for the cans themselves (purchase, storage, repair and the like). Finally, the sliver must also then be removed again from the cans at the downstream-connected processing machine.

SUMMARY OF THE INVENTION

It is an object of the invention to create a device of the aforementioned type that avoids the above-mentioned disadvantages. In particular, the device should permit the easy displacement of the deposited sliver (sliver bundle) in the depositing region and/or out of the depositing region of the machine, thus making possible a considerable reduction in the equipment expenditure for the system.

Embodiments of the invention provide a device on a spinning preparation machine for receiving a sliver from a discharge device of the spinning preparation machine and transporting the sliver to a downstream machine, the spinning preparation machine having a depositing region, the device comprises a support for receiving the sliver deposited from the discharge device in the depositing region; and a moving device for moving the deposited sliver relative to the discharge device in the depositing region for forming a free standing sliver bundle, and for moving the free standing sliver bundle out of the depositing region for transport to a downstream machine.

Other embodiments of the invention provide a method of depositing and transporting a sliver bundle. The method comprises discharging a sliver from a discharge device of a spinning preparation machine; depositing the discharged sliver on a movable support in a discharge region of the spinning preparation machine; moving the support back and forth inside the depositing region relative to the discharge device to create a free standing deposited sliver bundle on the support; and moving the support with the free-standing sliver bundle to a downstream machine.

Sliver processing can be simplified considerably due to the fact that the deposited sliver (sliver bundle) as such can be moved during the sliver deposit with mechanical means within the depositing region, as well as out of the depositing region following the sliver deposit. Also, the removal of the slivers from cans or the like at the downstream-connected processing machine, for example a spinning machine, is omitted. Added to this is a large reduction in the equipment expenditure for the system. A structural adaptation of the sliver delivery machine (draw frame, carding machine) to a can is not necessary. In particular, the full scope of expenditure required for purchasing, storing and repairing a large number of cans and the like is avoided.

BRIEF DESCRIPTION OF THE DRAWINGS

The invention is explained below in further detail with the aid of exemplary embodiments shown in the drawings, wherein.

DETAILED DESCRIPTION OF THE INVENTION

Figure 1A:
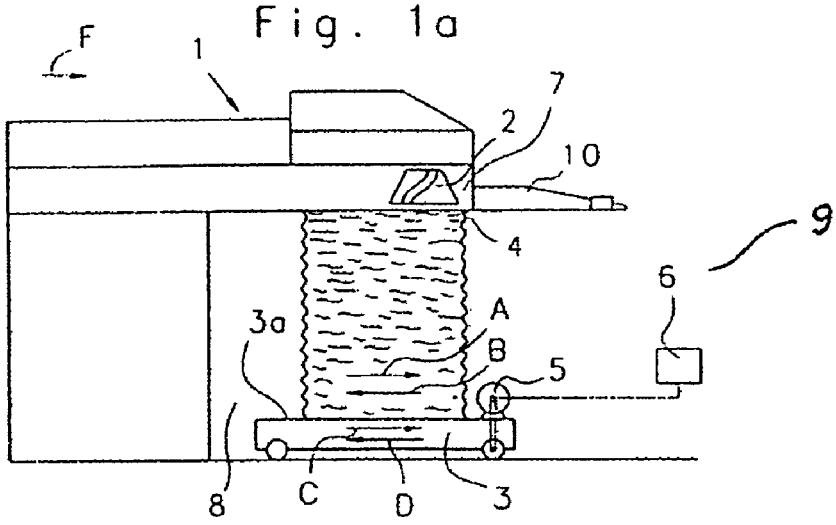
FIG. 1*a* is a schematic side elevation view of a draw frame with a device according to the invention, using a carriage for the sliver deposit, shown in one end position below a rotating plate.
Figure 1B:
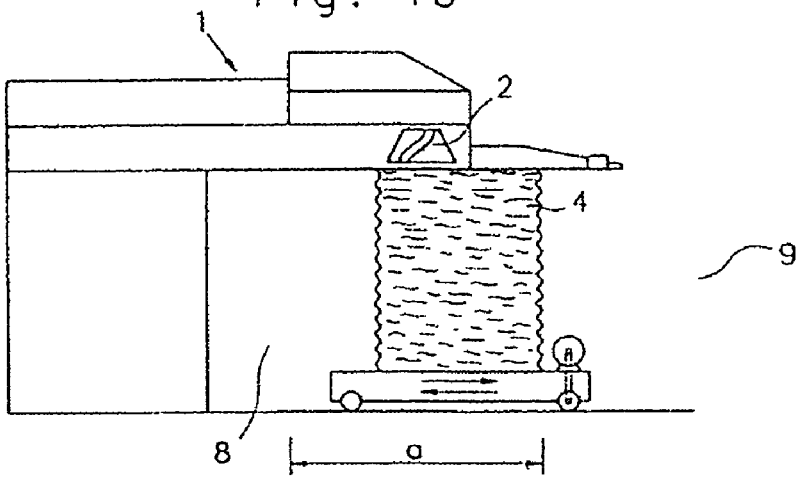
FIG. 1*b* shows the device according to FIG. 1*a*, but in the other end position below the rotating plate.
Figure 1C:
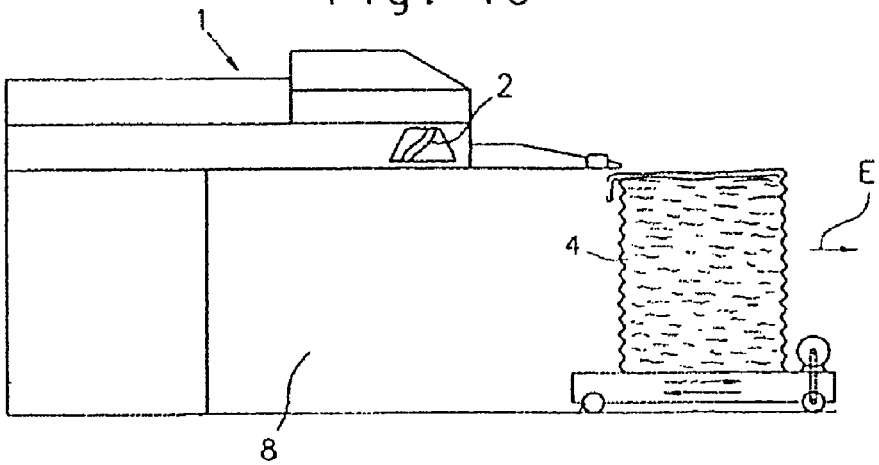
FIG. 1*c* shows the device according to FIGS. 1*a* and 1*b*, but outside of the sliver-depositing device.

FIG. 1 shows an example of a high-performance draw frame 1 (autoleveller) manufactured by the company Trützschler, Mönchengladbach, Germany, such as the high-performance draw frame HSR 1000, in a schematic side elevation view. Individual slivers are fed from a can into the drawing unit that is not shown herein. In this unit, the slivers are drawn and combined to form a single sliver, which exits the unit. The sliver then passes through a rotating plate 2 and is subsequently deposited as a ring-shaped sliver bundle 4 on a support, for example a carriage 3 with rectangular top surface 3*a*, which moves back and forth in the direction of arrows A and B. In this example, the rotating plate 2 rotates about fixed axis 102. The carriage 3 is operated with a controllable drive motor 5, which is connected to an electronic control and regulating device 6, for example a machine control. A cover plate 10 for the sliver depositing device (sliver coiler arrangement) is attached to a support plate 7. The arrow F indicates the operating direction (fiber-material flow) within the draw frame. The rotating plate 2 delivers the sliver bundle 4 in an essentially vertical direction. The depositing region is indicated by the reference number 8, while the region outside of the depositing region 8 is indicated by the reference number 9. The depositing region 8 comprises the drawing distance a according to FIG. 1*b*.

Carriage 3 moves back and forth horizontally below the rotating plate 2 while the sliver 4 is deposited. One end position of carriage 3 is shown in FIG. 1*a* while the other end position is shown in FIG. 1*b*. As a result, the sliver bundle 4 is also moved back and forth below the rotating plate 2 in the direction of arrows A and B. Once it reaches the end position shown in FIG. 1*a*, the carriage 3 moves in the direction of arrow C, wherein the carriage 3 is accelerated, then driven with a steady speed and subsequently decelerated again. After reaching the end position shown in FIG. 1*b*, the carriage 3 moves back in the direction of arrow D, wherein the carriage 3 is accelerated, then driven with a uniform speed and subsequently decelerated once more. The control unit 6 in connection with the drive motor 5 implements the back and forth movement.

The speed-controlled electric motor 5 drives the carriage 3 with a non-jolting or nearly non-jolting speed. The acceleration and deceleration, in particular, occur without jolting or nearly without jolting while the speed between the acceleration and deceleration remains uniform. The sliver bundle 4 thus remains stable during the back and forth movement in the depositing region 8, according to FIGS. 1*a* and 1*b*, as well as during the movement out of the depositing region 8 according to FIG. 1*c*. The movements are controlled in such a way that the highest possible production speed is realized, without slippage or tilting of the sliver bundle 4.

While the sliver is being deposited, the control unit 6 (see FIG. 1*a*) controls the back and forth movement of the carriage 3 to create a stable sliver bundle 4. In one embodiment, the rotating plate 2 rotates at a fixed location and discharges the sliver onto the carriage 3 at a constant charging pressure. The constant charging pressure is generated by discharging the sliver at a constant feed rate per material layer of sliver. For instance, the rotating plate 2 discharges sliver onto the carriage 3 at a constant rate so that each layer of sliver rings deposited during either the forward or backward movement receives a substantially uniform amount of sliver. Having a constant amount of sliver per layer promotes the stability of the sliver bundle 4.

The rate of the back and forth movement of the carriage 3 is also controlled to increase the stability of the sliver bundle 4. As the carriage 3 reaches the reversal point at either end of the back and forth movement, the control unit 6 decelerates the carriage 3 as the carriage 3 approaches a seam area 402*a* or 402*b* of the sliver bundle 4 and accelerates the carriage 3 as the carriage leaves the seam area 402*a* or 402*b*. In between the seam areas 402*a* and 402*b* on either side of the sliver bundle 4, the control unit 6 controls the carriage 3 to have a constant speed. The seam area 402*a* or 402*b* is the location on either end of the sliver bundle 4 where the sliver rings deposited on the carriage 3 do not completely overlap (see FIG. 4*a* and FIG. 4*b*). The seam area 402*a* or 402*b* occurs shortly before the reversal point of the movement of the carriage 3 at either end of the sliver bundle 4. In contrast, in the non-seam area 404, during either the forward or backward movement of the carriage 3, the back edge of each sliver ring is deposited on top of the front edge of a previously deposited sliver ring.

To account for less sliver being deposited in the seam area 402*a* or 402*b*, the control unit 6 decelerates the carriage 3 so that more sliver may be deposited in the seam area 402*a* or 402*b* and accelerates the carriage 3 to a constant speed in the non-seam area 404. The deceleration of the carriage 3 increases the amount of sliver deposited in the seam area 402*a* or 402*b* since the rotating plate 2 discharges the sliver at a constant rate independent of the movement of the carriage 3. When the carriage 3 decelerates, more sliver may be deposited at that location to account for the non-overlapping rings of sliver near the reversal points. The non-uniform speed of the carriage 3 permits a substantially uniform amount of sliver to be deposited at both the seam area 402*a* or 402*b* and the non-seam area 404 of the sliver bundle 4 for each layer of sliver deposited in the back and forth movement of the carriage 3. The non-uniform speed of the carriage 3 also provides substantially uniform density of the sliver at all locations within the sliver bundle 4. This uniform density of sliver permits the sliver bundle 4 to be formed stably on the carriage 3 and allows the sliver bundle 4 to be accelerated back and forth while minimizing the possibility that the canless, laterally unsupported, sliver bundle 4 will become unstable and topple over.

Once the depositing of the sliver bundle 4 on the surface 3*a* is complete, the carriage 3 together with the sliver bundle 4 moves in the direction of arrow E out of the sliver-depositing device (sliver coiler arrangement). The control unit 6 controls the movement of the carriage 3 for the changeover from the back and forth movement (arrows A, B) during the sliver deposit to the movement (arrow E) out of the depositing region 8.

Figure 2:
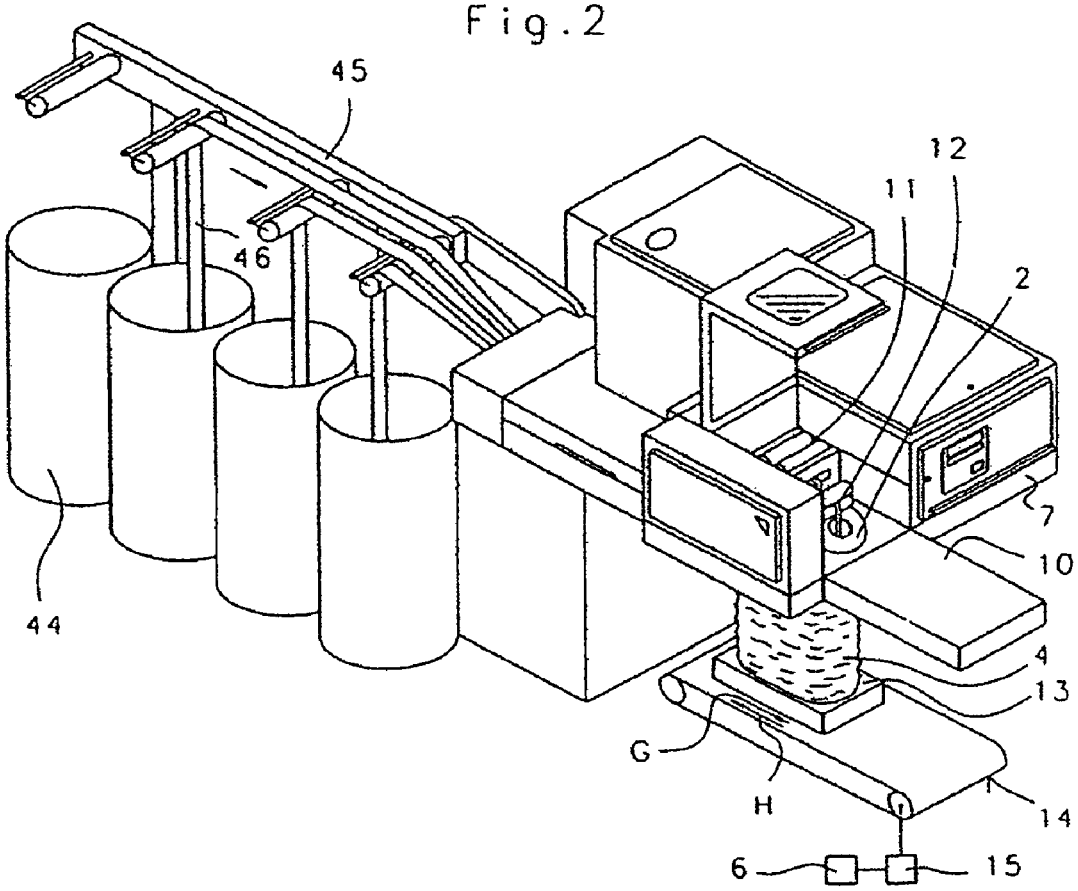
FIG. 2 is a perspective view of a draw frame with a sliver depositing device according to the invention using a conveyor belt for the sliver deposit.

In the embodiment of the invention shown in FIG. 2, round cans 44 are arranged below the sliver intake 45 and the feed slivers 46 are pulled off via rollers and fed into the draw frame. Following the passage through the draw frame 11, the drawn sliver 12 arrives at the rotating plate 2 and is deposited in rings on a rectangular plate 13. The plate 13 is arranged on an endlessly circulating conveyor belt 14, which is driven by a controllable electric motor 15 that ensures the back and forth movement of the conveying belt 14, the plate 13 and the sliver bundle 4 in the direction of arrows G, H. In this example, the conveyor belt 14 is at least twice as large as the maximum movement of the sliver bundle 4 in the horizontal direction in the depositing region. The electric motor 15 is connected to an electric control and regulating device 6.

Figure 3:
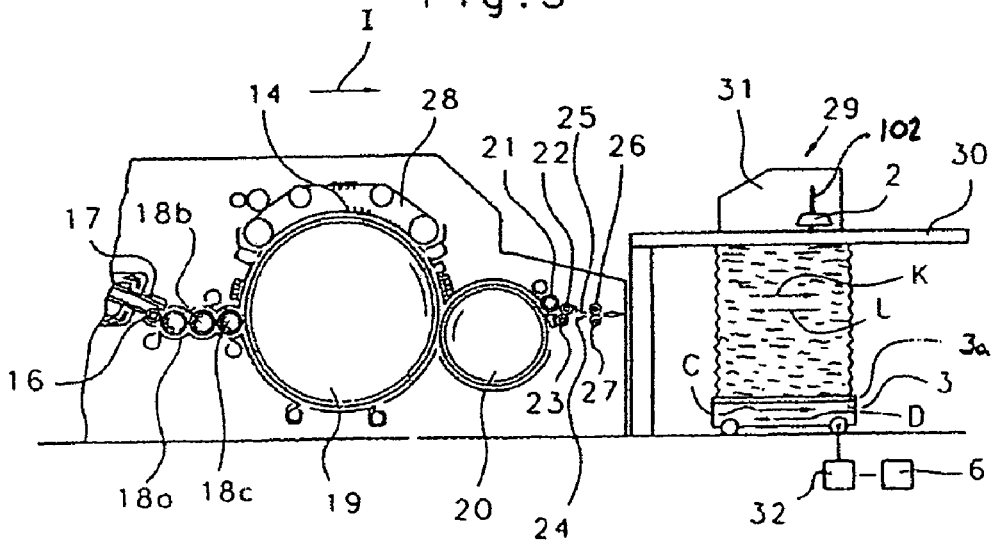
FIG. 3 is a schematic side elevation view of a carding machine with a device according to the invention.

FIG. 3 shows a carding machine, for example a Trützschler high-performance carding machine model DX 903, comprising a feed roller 16, feed table 17, licker-ins 18*a*, 18*b*, 18*c*, main carding cylinder 19, doffer 20, stripping roll 21, crushing rolls 22, 23, sliver guide element 24, web trumpet 25, withdrawing rolls 26, 27, traveling flats 28, 14 and sliver coiler arrangement 29. Curved arrows indicate the rotational directions of the rollers. The carding machine operating direction is shown by arrow I. A housing 31 with therein-disposed rotating plate 2 is located above the cover plate 30 for the sliver coiler arrangement. A sliver support is embodied as carriage 3, which is provided with a rectangular plate 3*a* on the top. During the sliver deposit on the rectangular plate 3*a*, the carriage 3 is moved back and forth in the direction of arrows K, L with the aid of a drive mechanism, for example the controlled motor 32.

Figure 4A:
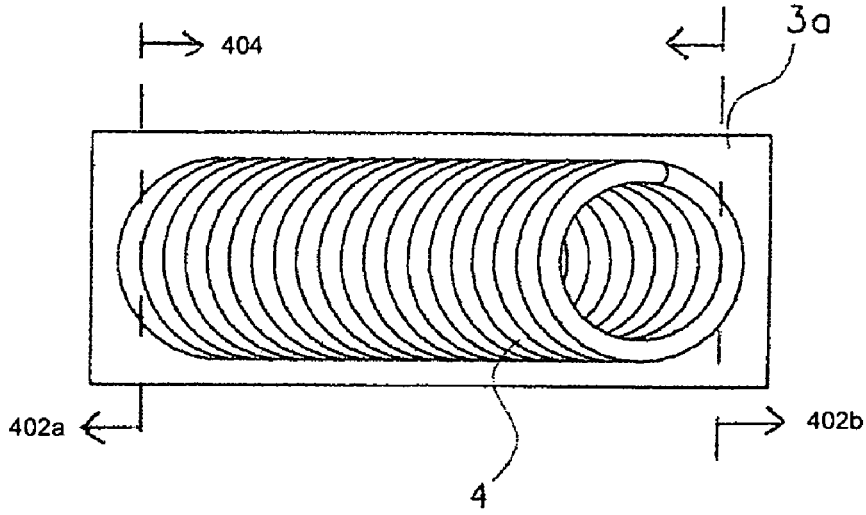
FIG. 4*a* is a top view of a sliver bundle deposited freely on the top of a carriage.
Figure 4B:
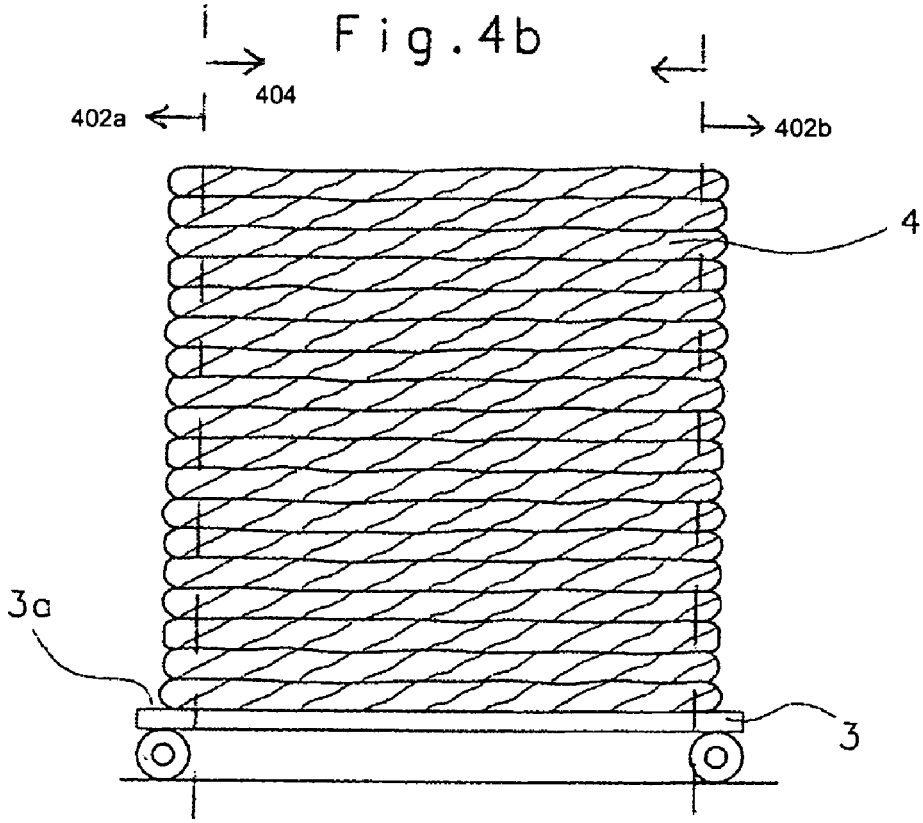
FIG. 4*b* is a side elevation view of the sliver bundle shown in FIG. 4*a;*

FIG. 4*a* shows a view from above of a ring-shaped sliver bundle 4, deposited freely on the top 3*a* of the carriage 3. FIG. 4*b* shows a view from the side of the sliver bundle 4 that is positioned freely on the carriage 3. As depicted in FIGS. 4*a* and 4*b*, the sliver bundle 4 is formed into a rectangular shape of sliver rings. The rectangular shape of the sliver bundle 4 is formed by the manner in which the sliver is deposited. The rotation of the rotating plate 2 as the sliver is discharged forms a layer of overlapping rings of sliver on a receiving surface of the carriage 3, and the movement of the carriage 3 back and forth under the control of the control unit 6 adjusts the locations at which the sliver rings are formed on the receiving surface. The movement of the carriage causes the deposited rings to be offset from one another and to partially overlap on the receiving surface of the carriage 3, which creates the substantially rectangular shape of the sliver bundle 4 when viewed from the top. At either end of the sliver bundle 4, the changing of the direction in the back and forth movement of the carriage 3 leaves the sliver bundle 4 with rounded ends for the rectangular shape, as best shown in FIG. 4*a*. In one embodiment, the rectangular shape of the sliver bundle 4 is advantageous since it promotes the stability of the sliver bundle, as compared with conical or cylindrical shaped sliver bundles.

Figure 5A:
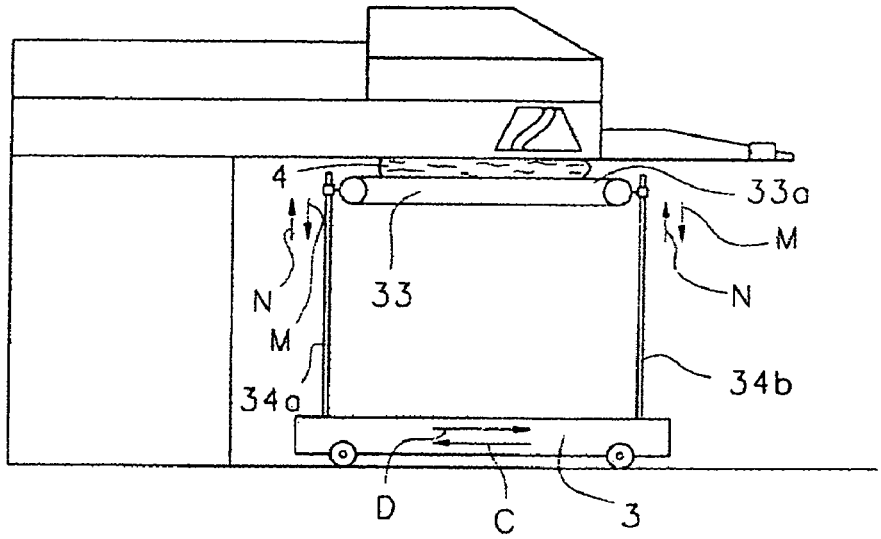
FIG. 5*a* is a side elevation view of an embodiment of the invention using a conveyor belt that can be raised and lowered and functions as sliver deposit and removal device during the depositing operation.

FIG. 5*a* illustrates a further exemplary embodiment of the movement of the devices according to the claimed invention. FIG. 5*a* shows a carriage 3 with a holding device 34*a*, 34*b*, for example a post, arranged on the top. A conveyor belt 33 is attached to this holding device, such that it can be displaced up or down in the direction of arrows M, N. In this example, the conveyor belt 33 has a length substantially equal to a maximum movement of the sliver bundle in the horizontal direction in the depositing region. The sliver bundle 4 is deposited on the upper belt section 33*a* of the conveyor belt 33. During the sliver deposit, the carriage 3 moves back and forth in the direction of arrows C, D. After reaching each respective end position (compare FIGS. 1*a*, 1*b*), the conveyor belt 33 is displaced downward in the direction M by as much as a sliver thickness, for example 10 mm, with the aid of a drive motor (not shown herein) to create a substantially constant space for the next layer of sliver material to be deposited into. The substantially constant space refers to the temporary area between the top of the laterally unsupported sliver bundle 4 and the bottom of the rotating plate 2. This space is immediately filled with new sliver material to create a constant filling pressure for each layer of sliver deposited. The substantially constant space permits only a substantially constant amount of area for sliver to be deposited for each layer of sliver. A layer of sliver may be considered the amount of sliver deposited between a single pair of movement reversal points for the carriage 3 (i.e., from the point at which the movement of the carriage 3 changes direction until the next reversal point). Discharging the sliver into the substantially constant space allows a substantially uniform density of sliver to be formed at all locations within the sliver bundle 4, which promotes stability of the sliver bundle 4.

Figure 5B:
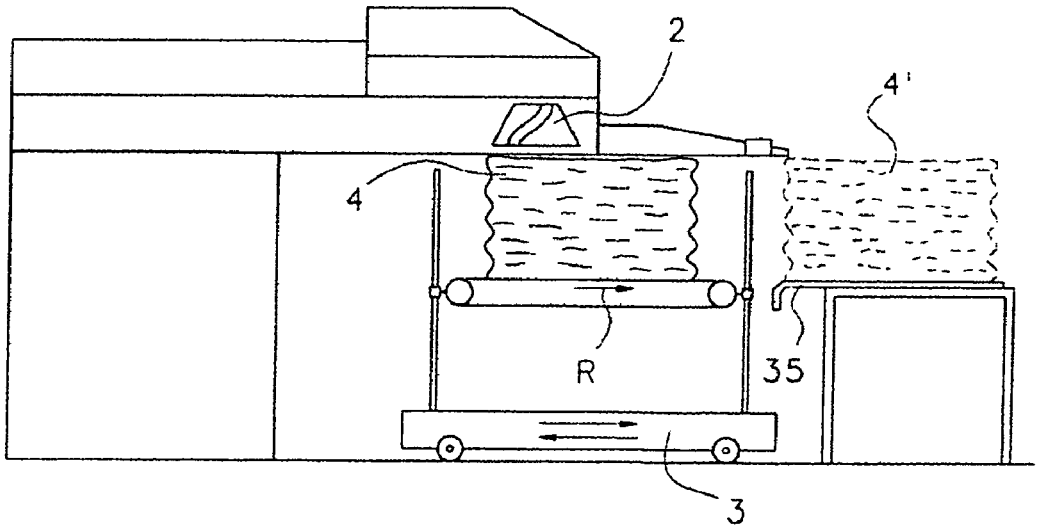
FIG. 5*b* is a side elevation view of the embodiment shown in FIG. 5*a* during the removal operation.

As shown in FIG. 5*b*, when the sliver depositing operation is completed, the upper belt section 33*a* is moved in the direction R, for example with a controlled drive motor (not shown herein), so that the sliver bundle 4, 4' is pushed onto a secondary, essentially flat supporting surface 35, for example a transporting tray. The edge of the support surface 35, which faces the carriage 3 for example, is beveled, rounded or has a similar shape.

Figure 6:
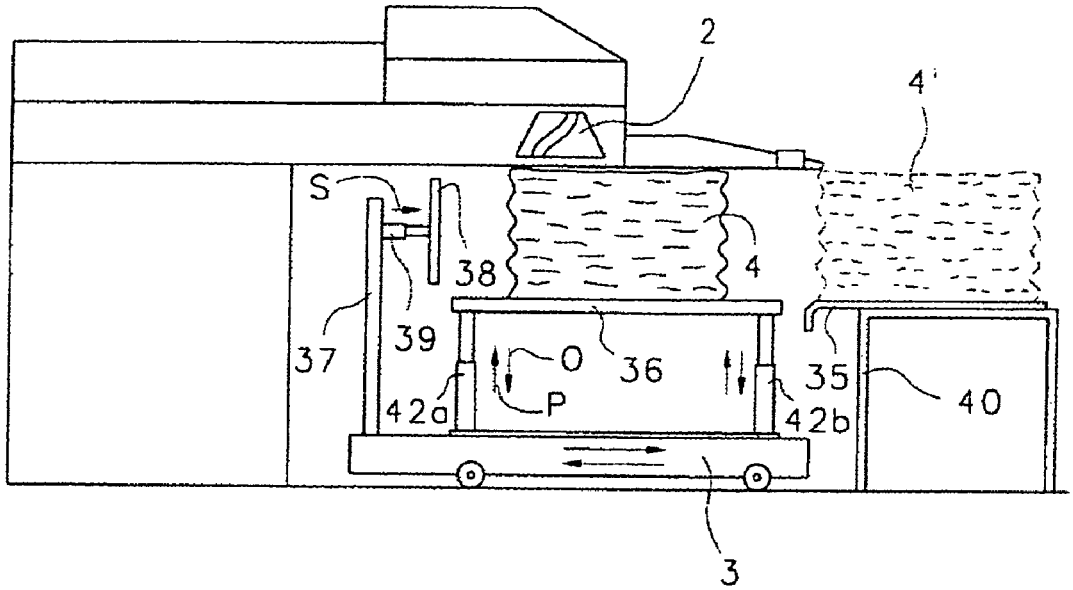
FIG. 6 is a side elevation view of an embodiment of the invention having a thrust device fox the sliver bundle changeover.

FIG. 6 illustrates another exemplary embodiment of an apparatus according to the present invention. As shown, a lifting base 36, for example a platform, is arranged on the carriage 3, which can be attached to holding elements in the manner shown in reference DE 44 07 849 A1. The lifting base 36 can be adjusted in the direction of arrows O, P by means of lifting elements 42*a*, 42*b*, for example controlled pneumatic cylinders. The carriage 3 is provided with a support element 37, for example a post. A sliding device 38 is attached to this post via a suitable, controlled drive element 39, for example a pneumatic cylinder, a spindle drive, or the like. Once the sliver bundle 4 is deposited completely on the surface of the lifting base 36, the sliding device 38 is moved in the direction of arrow S toward the sliver bundle 4. The sliver bundle 4 is thus pushed from the lifting base 36 onto the support surface 35 through direct pressure exerted by the sliding device 38. The support surface 35 rests on a frame 40 or the like, can be removed from the surface of the frame 40 together with the sliver bundle 4' and can be supplied to a downstream-connected processing device, for example a spinning machine, or to a storage area.

Figure 7:
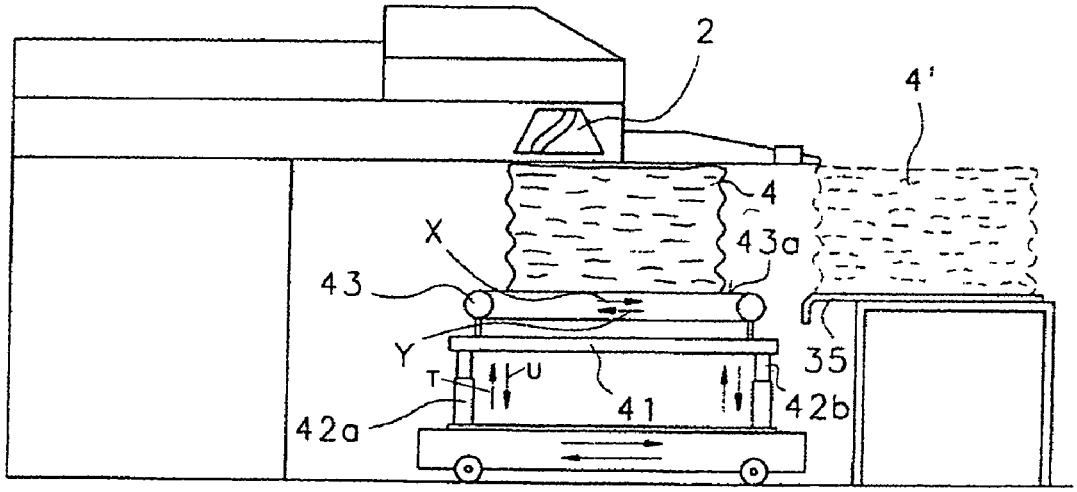
FIG. 7 is a side elevation view of an embodiment of the invention having a lifting device and extended conveyor belt which function simultaneously for traversing and removal.

FIG. 7 shows a lifting platform 41, which can be lifted and stopped in the direction of arrows T, U by means of lifting elements 42*a*, 42*b*, for example controlled pneumatic cylinders. A conveyor belt 43 is provided on the surface of lifting platform 41, the belt sections of which can be moved in the direction of arrows X, Y. The drive and control of the conveyor belt 43 correspond to the type shown in FIG. 2. During the depositing operation, the upper belt section 43*a* is moved back and forth underneath the rotating plate 2, in the direction of arrows X, Y. Once the sliver is deposited as sliver bundle 4 on the upper belt section 43*a*, a control unit 6 (see FIG. 2) controls a drive motor 15 (see FIG. 2) in such a way that the upper belt section 43*a* moves the sliver bundle 4 out of the depositing region 8 underneath the rotating plate 2 and places it onto a support surface 35.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. A fiber deposit apparatus at a spinning preparation machine, comprising a discharge device adapted to discharge fiber sliver in a depositing area;

a moveable apparatus adapted to be displaced back and forth in a horizontal direction relative to the discharge device in the depositing area, said moveable apparatus having a substantially planar receiving surface adapted to receive the sliver, said moveable apparatus being adapted to move the substantially planar receiving surface in the horizontal direction to form a laterally unsupported sliver bundle;

a control unit operably coupled to the moveable apparatus, said control unit being adapted to move said moveable apparatus back and forth in the horizontal direction at a non-uniform speed, wherein the non-uniform speed is constant during a non-seam area and decelerates in a seam area of the laterally unsupported sliver bundle; and a displacing device adapted to displace the laterally unsupported sliver bundle from the depositing area.

2. The fiber deposit apparatus according to claim 1, wherein after each change in direction of said moveable apparatus, said moveable apparatus adjusts the receiving surface in a vertical direction to accommodate for a change in size of the laterally unsupported sliver bundle and to maintain a substantially constant pressure between the top of the laterally unsupported sliver bundle and said discharge device.

3. The fiber deposit apparatus according to claim 2, wherein said moveable apparatus further comprises:

a lifting and lowering device for lifting and lowering the receiving surface in the vertical direction, the lifting and lowering device being one of a hydraulic cylinder or a pneumatic cylinder.

4. The fiber deposit apparatus according to claim 1, wherein a rotational axis of the discharge device is positionally fixed.

5. The fiber deposit apparatus according to claim 1, wherein said displacing device comprises a conveyor belt.

6. The fiber deposit apparatus according to claim 5, wherein a horizontal length of the conveyor belt is substantially equal to a maximum movement of the laterally unsupported sliver bundle in the horizontal direction in the depositing region.

7. The fiber deposit apparatus according to claim 5, wherein a horizontal length of the conveyor belt is at least twice as long as a maximum movement of the laterally unsupported sliver bundle in the horizontal direction in the depositing region and projects out of the depositing region during depositing of the sliver by said discharge device.

8. The fiber deposit apparatus according to claim 5, wherein the conveyer belt is adapted to move the laterally unsupported sliver bundle back and forth inside the depositing region.

9. The fiber deposit apparatus according to claim 1, further comprising a controllable drive mechanism that drives said displacing device.

10. The fiber deposit apparatus according to claim 9, further comprising an electronic control and regulating device, wherein the controllable drive mechanism is controlled by the electronic control and regulating device.

11. The fiber deposit apparatus according to claim 1, wherein the receiving surface has a top surface that facilitates easy sliding of the laterally unsupported sliver bundle.

12. The fiber deposit apparatus according to claim 1, wherein the displacing device further comprises a mechanical device for pushing the laterally unsupported sliver bundle off of the receiving surface.

13. The fiber deposit apparatus according to claim 1, wherein the laterally unsupported sliver bundle has a rectangular shape formed of overlapping rings.

14. The fiber deposit apparatus according to claim 1, wherein the receiving surface is an upper surface of a conveyor belt.

15. The fiber deposit apparatus according to claim 1, wherein the receiving surface is a part of a lifting platform.

16. The fiber deposit apparatus according to claim 1, wherein the displacing device displaces said laterally unsupported sliver bundle substantially jolt-free out of the depositing region.

17. A device on a spinning preparation machine comprising:

a discharge device adapted to rotationally discharge sliver in a depositing region; and a moveable apparatus moveable back and forth in a horizontal direction relative to said discharge device in the depositing region, said moveable apparatus having a receiving surface adapted to receive the sliver, said moveable apparatus being adapted to move the receiving surface in the horizontal direction relative to the discharge device to form a laterally unsupported sliver bundle on the receiving surface, said moveable apparatus being adapted to move the laterally unsupported sliver bundle out of the depositing region, wherein after each change in direction of the back and forth movement of said moveable apparatus in the horizontal direction, said moveable apparatus adjusts the receiving surface in a vertical direction to accommodate for a change in size of the laterally unsupported sliver bundle and to maintain a substantially constant pressure between the top of the laterally unsupported sliver bundle and said discharge device; and a control unit operably coupled to the moveable apparatus, the control unit being adapted to move the moveable apparatus back and forth in the horizontal direction at a non-uniform speed, wherein the non-uniform speed is constant during a non-seam area and decelerates in a seam area of the laterally unsupported sliver bundle.

18. A method comprising:

discharging sliver in a depositing region from a rotating discharge device onto a receiving surface of a moveable apparatus;

moving the moveable apparatus back and forth in a horizontal direction relative to the rotating discharge device to form a laterally unsupported sliver bundle, wherein said moveable apparatus moves at a non-uniform rate when moving back and forth in the horizontal direction, such that said moveable apparatus decelerates in a seam area of the laterally unsupported sliver bundle and moves at a uniform speed in a non-seam area of the laterally unsupported sliver bundle; and displacing said laterally unsupported sliver bundle out of the depositing region.

19. The method according to claim 18, further comprising:

adjusting the receiving surface in a vertical direction during each change in the horizontal direction of the moveable apparatus to accommodate for a change in size of the laterally unsupported sliver bundle and to maintain a substantially constant pressure between the top of the laterally unsupported sliver bundle and said rotating discharge device.

* * * * *